US008730107B2

(12) United States Patent
Yu et al.

(10) Patent No.: US 8,730,107 B2
(45) Date of Patent: May 20, 2014

(54) MULTI-FREQUENCY ANTENNA

(75) Inventors: Yen-Hao Yu, Taipei County (TW); Shih-Chia Liu, Taipei County (TW); Tsung-Wen Chiu, Taipei County (TW); Fu-Ren Hsiao, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 384 days.

(21) Appl. No.: 13/152,643

(22) Filed: Jun. 3, 2011

(65) Prior Publication Data

US 2012/0169544 A1 Jul. 5, 2012

(30) Foreign Application Priority Data

Dec. 30, 2010 (TW) ..... 99146897 A

(51) Int. Cl.
*H01Q 9/04* (2006.01)

(52) U.S. Cl.
USPC ..... 343/700 MS

(58) Field of Classification Search
USPC ..... 343/700 MS
See application file for complete search history.

(56) References Cited

U.S. PATENT DOCUMENTS

| | | | | |
|---|---|---|---|---|
| 6,734,825 | B1 * | 5/2004 | Guo et al. | 343/700 MS |
| 6,762,723 | B2 * | 7/2004 | Nallo et al. | 343/700 MS |
| 6,870,505 | B2 * | 3/2005 | Aisenbrey | 343/700 MS |
| 8,111,195 | B2 * | 2/2012 | Hung et al. | 343/700 MS |
| 8,134,517 | B2 * | 3/2012 | Wang et al. | 343/846 |
| 8,237,614 | B2 * | 8/2012 | Kuramoto et al. | 343/700 MS |
| 8,456,369 | B2 * | 6/2013 | Chen et al. | 343/702 |

* cited by examiner

*Primary Examiner* — Seung Lee
(74) *Attorney, Agent, or Firm* — Schmeiser, Olsen & Watts, LLP

(57) ABSTRACT

A multi-frequency antenna comprises a first conductor, a second conductor, a grounding member, and a third conductor. The first and second conductors are respectively arranged on a first plane and a second plane. The grounding member is arranged on a third plane existing between the first and second planes. The third conductor is connected with the first conductor and arranged on the first plane also. The first and third conductors are respectively coupled to the radiated signals of the second conductor to form a first electrical path and a second electrical path. The first electrical path and the second electrical path have a phase difference of 180 degrees. The present invention features the additional third conductor. The third conductor and the first conductor are coupled to the radiated signals of the second conductor to generate opposite-phase signals. Thus are counterbalanced the interferences among the antenna systems of an identical frequency band.

10 Claims, 3 Drawing Sheets

MULTI-FREQUENCY ANTENNA

BACKGROUND OF THE INVENTION

1. Field of the Invention

The present invention relates to a multi-frequency antenna, particularly to a multi-frequency antenna, wherein radiation conductors of an identical operation frequency band are integrated into a single antenna module.

2. Description of the Related Art

With fast progress of wireless communication technology, RF channels become more and more crowded. Wireless communication technology has expanded from dual-band systems to triple-band or even quad-band systems. In 2007, the industry of notebook computer's antenna has a bigger change: The wireless communication begins to enter the 3G or 3.5G age after the Centrino chip had pushed the maturation of built-in WLAN. Thus, the number of the built-in antennae also increases. The current notebook computers are mainly equipped with built-in antennae. In the Centrino age, there are only two built-in antennae. In the 3G age, there may be 5-6 built-in antennae. The additional antennae include an 802.11n MIMO antenna, two 3G antennae, and even one or two UWB antennae.

After notebook computers joined the mobile communication industry, the manufacturers have to propose a sophisticated antenna design and a superior RF system implementation tactic, in addition to a standard 3 G communication module, so that the notebook computers can transceive signals accurately and noiselessly in a communication environment full of interference. Further, a notebook computer involves many communication systems, such as GPS, BT, Wi-Fi, WiMax, 3G/LTE and DTV. How to achieve an optimized design compatible to these wireless communication systems has been a critical technology in the field. The customers have a very high requirement for the compactness and slimness of notebook computers. How to integrate more and more antenna modules into smaller and smaller space without mutual interference becomes a big challenge for designers.

SUMMARY OF THE INVENTION

The primary objective of the present invention is to provide a multi-frequency antenna, which has an additional third conductor, wherein a first conductor couples with the radiation signal of a second conductor to form a first path, and wherein the third conductor couples with the radiation signal of the second conductor to form a second path, and wherein a 180-degree phase difference exists between the first path and the second path, and wherein the feed-in signals of the first and third conductors couple with the second conductor to generate opposite-phase signals, whereby is counterbalanced the interference among the antenna systems of an identical frequency band.

Another objective of the present invention is to provide a multi-frequency antenna, wherein radiation conductors of the same operation frequency band are integrated in a single antenna module and disposed on different planes thereof to reduce in-phase interference among the antenna systems of an identical frequency band and miniaturize the antenna module simultaneously.

To achieve the abovementioned objectives, the present invention proposes a multi-frequency antenna, which comprises a first conductor, a second conductor, a grounding member, and a third conductor. The first conductor is arranged on a first plane. The second conductor is arranged on a second plane. The grounding member is arranged on a third plane existing between the first plane and the second plane. The first, second, third planes are arranged on the corresponding surfaces and parallel to each other. The third conductor is connected with the first conductor and arranged on the first plane also. The first conductor is coupled to the radiation signal of the second conductor to form a first path. The third conductor is coupled to the radiation signal of the second conductor to form a second path. The first path and the second path have a phase difference of 180 degrees.

The present invention integrates the radiation conductors of an identical operation frequency band into a single antenna module. In the present invention, the first conductor and the second conductor belong to the same operation frequency band and may interfere with each other. The present invention provides an additional third conductor, makes the first conductor couple with the radiation signal of the second conductor to form the first path, and makes the third conductor couple with the radiation signal of the second conductor to form the second path, wherein a 180-degree phase difference exists between the first path and the second path, and wherein the high-frequency feed-in signals of the first conductor and the third conductor are coupled to the second conductor to generate opposite-phase signals, whereby is counterbalanced the interference among the antenna systems of an identical frequency band.

In the present invention, the radiation conductors of an identical frequency band are integrated in a single antenna module and respectively disposed on different planes of the antenna module, whereby to reduce in-phase interference among identical frequency band antenna systems and miniaturize the antenna module simultaneously.

The embodiments are described in detail to make easily understood the technical contents of the present invention.

DETAILED DESCRIPTION OF THE INVENTION

Figure 1:
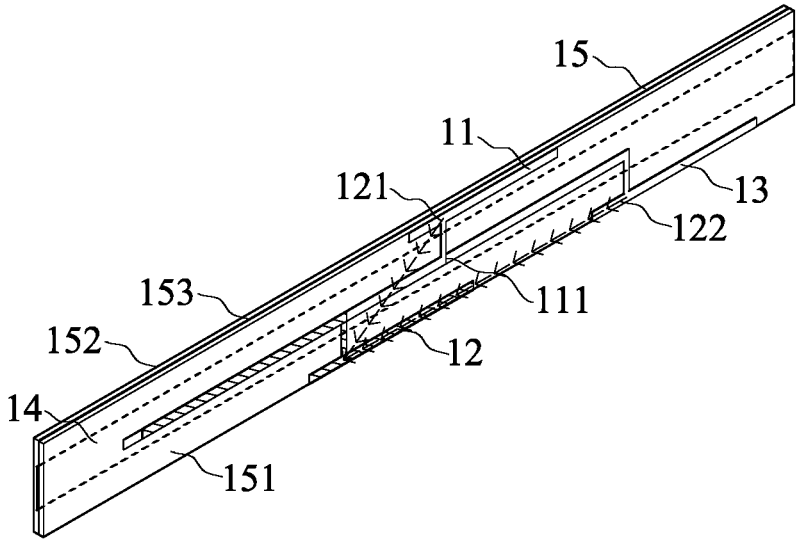
FIG. 1 is a top view of a multi-frequency antenna according to one embodiment of the present invention.

Refer to FIG. 1 which is a top view of a multi-frequency antenna according to one embodiment of the present invention. The present invention proposes a multi-frequency antenna, which comprises a first conductor 11, a second conductor 12, a grounding member 14 and a third conductor 13.

The first conductor 11 is arranged on a first plane 151. The second conductor 12 is arranged on a second plane 152. The grounding member 14 is arranged on a third plane 153 existing between the first plane 151 and the second plane 152. Gaps exist among the first plane 151, the second plane 152 and the third plane 153. The gap may accommodate air, glass, an acrylic board, or a printed circuit board. In this embodiment, the gap accommodates a printed circuit board. The first plane 151, the second plane 152 and the third plane 153 are respectively disposed on corresponding surfaces and parallel to each other. The positions where the conductors are disposed overlap. The third conductor 13 is connected with the extension interface 111 of the first conductor 11 and disposed on the first plane 151 also.

Figure 6:
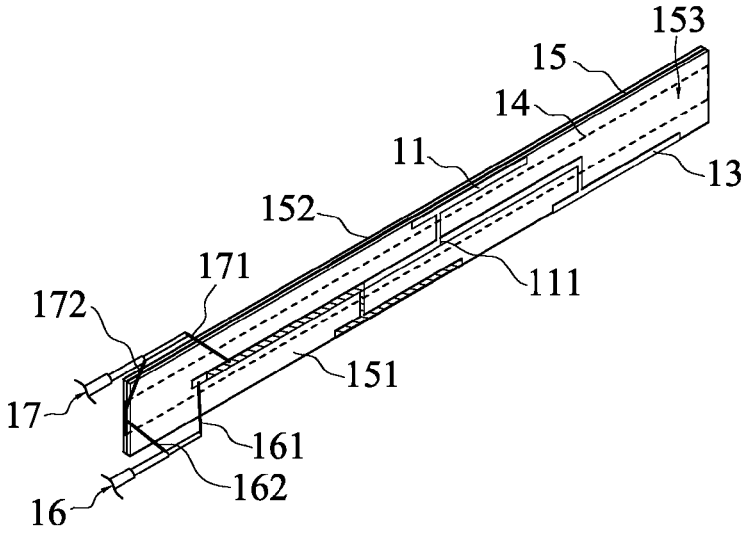
FIG. 6 is a top view of a multi-frequency antenna with feeder cables according to one embodiment of the present invention.

Refer to FIG. 6 which is a top view schematically a multi-frequency antenna with feed cables according to one embodiment of the present invention. A first feed cable 16 includes a first central conductor 161 connected with a lower rectangle segment of the first conductor 11 such that a first feed-in signal of the first feed cable 16 is transmitted to the extension interface 111 along the lower rectangle segment of the first conductor 11 and then is transmitted to an upper rectangle segment of the first conductor 11 via a connection rectangle segment of the first conductor 11, and wherein the lower rectangle segment of the first conductor 11 is longer than the upper rectangle segment of the first conductor 12, and the connection rectangle segment of the first conductor 11 is defined between the lower rectangle segment and the upper rectangle segment of the first conductor 11. The first feed-in signal of the first feed cable 11 is transmitted to the extension interface 111 along the lower rectangle segment of the first conductor 11, and then the first feed-in signal of the first feed cable 11 is transmitted to a lower rectangle segment of the third conductor 13 via an upper rectangle segment of the third conductor 13 connected with the extension interface 111 and a connection segment of the third conductor 13, wherein the connection segment of the third conductor 13 is defined between the upper rectangle segment and the lower rectangle segment of the third conductor 13. Furthermore, a second central conductor of the second feed cable 12 is connected with an upper rectangle segment of the second conductor 12, such that a second feed-in signal of the second feed cable 12 is transmitted to a connection rectangle segment of the second conductor 12 along an upper rectangle segment of the second conductor 12 and then is transmitted to a lower rectangle segment of the second conductor 12 via the connection rectangle segment of the second conductor 12, wherein the upper rectangle segment of the second conductor 12 is longer than the lower rectangle segment of the second conductor 12, and the connection rectangle segment of the second conductor 12 is defined between the upper rectangle segment and the lower rectangle segment of the second conductor 12. The first feed-in signal is transmitted to a connection area between the connection rectangle segment and the upper rectangle segment of the first conductor 11 so as to generate a first radiated signal from the connection area of the connection rectangle segment and the upper rectangle segment of the first conductor 11, and the first radiated signal is transmitted from the connection area between the connection rectangle segment and the upper rectangle segment of the first conductor 11 to a connection area between the connection rectangle segment and the lower rectangle segment of the second conductor 12 to generate a first electrical path (indicated by the arrows). The first feed-in signal is transmitted to a connection area between the connection rectangle segment and the lower rectangle segment of the third conductor 13 so as to generate a second radiated signal from the connection area between the connection rectangle segment and the lower rectangle segment of the third conductor 13, and the second radiated signal is transmitted from the connection area between the connection rectangle segment and the lower rectangle segment of the third conductor 13 to the connection area between the connection rectangle segment and the lower rectangle segment of the second conductor 13 to generate a second electrical path (indicated by the arrows). The first electrical path 121 and the second electrical path 122 respectively have different lengths, and a 180-degree phase difference exists therebetween.

In this embodiment, the first conductor 11, the second conductor 12 and the third conductor 13 all belong to antenna systems of an identical operation frequency band and thus may interfere with each other. The present invention features a third conductor 13. The high-frequency feed-in signal of the first conductor 11 is coupled to the radiated signal of the second conductor 12 to form the first electrical path 121. The high-frequency feed-in signal of the third conductor 13 is coupled to the radiated signal of the second conductor 12 to form the second electrical path 122. The first electrical path 121 and the second electrical path 122 have a 180-degree phase difference therebetween. Thus are generated opposite-phase signals when the feed-in signals of the first conductor 11 and the third conductor 13 are coupled to the second conductor 12. Thereby are counterbalanced the interference among the first conductor 11, the second conductor 12 and the third conductor 13, which all belong to antenna systems of an identical frequency band.

In this embodiment, each of the first conductor 11, the second conductor 12 and the third conductor 13 has an about inverted-7 shape including three rectangle segments. In the first conductor 11, the upper rectangle segment, which does not contact the extension interface 111, has a length of about 20 mm and a width of about 1 mm; the middle and shortest connection rectangle segment has a length of about 4 mm and a width of about 1 mm; the lower rectangle segment has a length of about 43 mm and a width of about 1 mm. In the second conductor 12, the lower rectangle segment has a length of about 23 mm and a width of about 1 mm; the middle and shortest connection rectangle segment has a length of about 4 mm and a width of about 1 mm; the upper and longest rectangle segment has a length of about 29 mm and a width of about 1 mm. In the third conductor 13, the upper rectangle segment, which contacts the extension interface 111, has a length of about 24 mm and a width of about 1 mm; the middle and shortest connection rectangle segment has a length of about 4 mm and a width of about 1 mm; the lower rectangle segment has a length of about 22 mm and a width of about 1 mm. The grounding member 14 is disposed on the third plane 153 and has a rectangular shape with a length of about 102 mm and a width of about 5 mm. The printed circuit board 15 has a rectangular shape with a length of about 102 mm, a width of about 1 mm and a thickness of about 2 mm.

Figure 2:
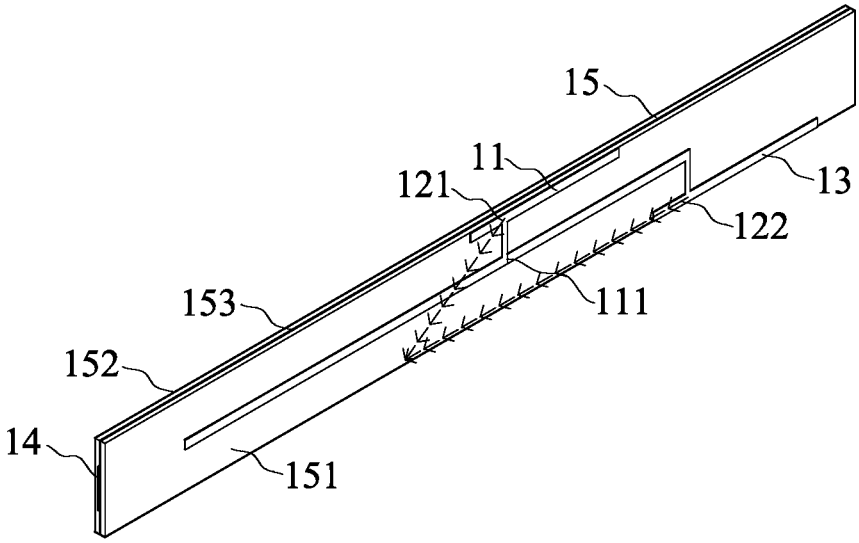
FIG. 2 is a top view of a first plane according to one embodiment of the present invention.
Figure 3:
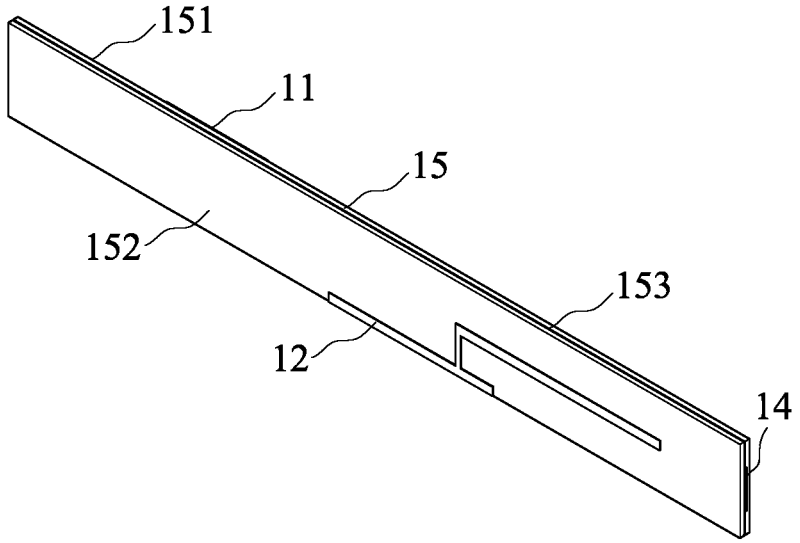
FIG. 3 is a top view of a second plane according to one embodiment of the present invention.

Refer to FIG. 2 and FIG. 3 which are top views of the first plane and the second plane according to one embodiment of the present invention. The present invention features an additional third conductor 13. The first conductor 11, the second conductor 12 and the third conductor 13 are separately disposed on the first plane 151, the second plane 152 and the third plane 153 of the printed circuit board 15. The first plane 151, the second plane 152 and the third plane 153 are arranged on corresponding parallel surfaces. The positions where the first conductor 11, the second conductor 12 and the third conductor 13 are disposed overlap. The high-frequency feed-in signals of the first conductor 11 and the third conductor 13 are transmitted to the second conductor 12 via the radiated coupling effect, whereby are generated the first electrical path 121 and the second electrical path 122. The first electrical path 121 and the second electrical path 122 have a phase difference of 180 degrees. Thus are generated opposite-phase signals after the first conductor 11 and the third conductor 13 are coupled to the second conductor 12. Thereby are counterbalanced the interference among the three conductors, which belong to identical frequency band antenna systems.

Figure 4:
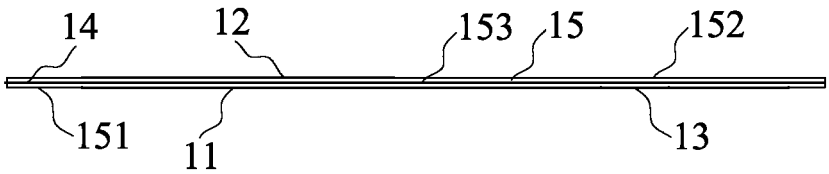
FIG. 4 is a side view of a multi-frequency antenna according to one embodiment of the present invention.

Refer to FIG. 4 which is a side view of a multi-frequency antenna according to one embodiment of the present invention. In the present invention, the first conductor 11, the second conductor 12 and the third conductor 13 are separately disposed on the first plane 151, the second plane 152 and the third plane 153 of the printed circuit board 15. The design that the radiated conductors are respectively disposed on adjacent parallel planes can effectively reduce the in-phase interference among identical frequency band antenna systems and miniaturize the antenna structure.

Figure 5:
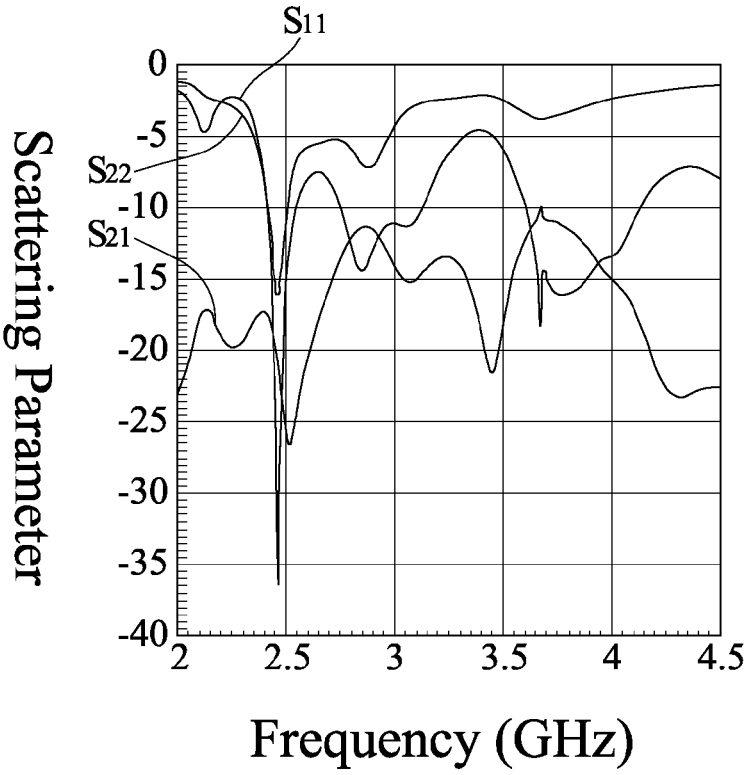
FIG. 5 is a diagram showing the results of isolation measurement according to one embodiment of the present invention.

Refer to FIG. 5 which is a diagram showing the results of isolation measurement according to one embodiment of the present invention, wherein the horizontal axis represents frequencies (GHz) and the vertical axis represents S parameter values (dB). In FIG. 5, the S parameter values of the frequency S 11 of the first conductor 11 and the third conductor 13 and the frequency S22 of the second conductor 12 are all lower than −10 dB at the frequency of 2.4-2.5 GHz. It shows that the first antenna represented by the first conductor 11 and the third conductor 13 and the second antenna represented by the second conductor 12 have superior impedance matching. The present invention provides an additional third conductor 13. After the high-frequency feed-in signals of the first conductor 11 and the third conductor 13 are coupled to the second conductor 12, the frequency S21 is even lower than −22 dB, as shown in FIG. 5. It proves that the interference among the identical frequency band antenna systems has been greatly reduced, and that the isolation parameter has been greatly improved. Therefore, the present invention can indeed reduce the interference among the identical frequency band antenna systems.

Refer to FIG. 6 which is a top view schematically a multi-frequency antenna with feed cables according to one embodiment of the present invention. When the antenna module of the present invention is integrated with a wireless communication device, a first central wire 161 of a first feed cable 16 is connected with the first conductor 11, and a first outer conductor 162 of the first feed cable 16 is connected with the grounding member 14. A second central conductor 171 of the second feed cable 17 is connected with the second conductor 12, and a second outer conductor 172 of the second feed cable 17 is connected with the grounding member 14. The plurality of identical frequency band conductors is separately disposed on adjacent different planes of a single printed circuit board 15. Thereby is greatly reduced the space for radiated conductor layout, decreased the wiring complexity, promoted the transmission efficiency of the feed cables, and avoided the mutual interference of signals.

From the above description, it is known that the present invention possesses utility, novelty and non-obviousness and meets the condition for a patent. Thus, the Inventor files the application for a patent. It will be appreciated if the patent is approved fast.

The embodiments described above are only to exemplify the present invention but not to limit the scope of the present invention. Any equivalent modification or variation according to the scope of the present invention is to be also included within the scope of the present invention.

What is claimed is:

1. A multi-frequency antenna comprising;

a first conductor which is disposed on a first plane and comprises three rectangle segments which are an upper rectangle segment, a connection rectangle segment, and a lower rectangle segment;

a second conductor which is disposed on a second plane and comprises three rectangle segments which are a lower rectangle segment, a connection rectangle segment, and an upper rectangle segment;

a grounding member disposed on a third plane between said first plane and said second plane, wherein said first plane, said second plane and said third plane are disposed on corresponding surfaces respectively and parallel to each other;

a third conductor which is connected with an extension interface of said first conductor and disposed on said first plane and comprises three rectangle segments which are an upper rectangle segment, a connection rectangle segment, and a lower rectangle segment, wherein a first feed cable which includes a first central conductor connected with said lower rectangle segment of said first conductor such that a first feed-in signal of said first feed cable is transmitted to said extension interface along said lower rectangle segment of said first conductor and then is transmitted to said upper rectangle segment of said first conductor via said connection rectangle segment of said first conductor, wherein said connection rectangle segment of said first conductor is defined between said lower rectangle segment and said upper rectangle segment of said first conductor;

said first feed-in signal of said first feed cable is transmitted to said extension interface along said lower rectangle segment of said first conductor, and then said first feed-in signal of said first feed cable is transmitted to said lower rectangle segment of said third conductor via said upper rectangle segment of said third conductor connected with the extension interface and said connection rectangle segment of said third conductor, wherein said connection rectangle segment of said third conductor is defined between said upper rectangle segment and said lower rectangle segment of said third conductor;

a second central conductor of said second feed cable is connected with said upper rectangle segment of said second conductor, such that a second feed-in signal of said second feed cable is transmitted to said connection rectangle segment of said second conductor along said upper rectangle segment of said second conductor and then is transmitted to said lower rectangle segment of said second conductor via said connection rectangle segment of said second conductor, wherein said connection rectangle segmen of said second conductor is defined between said upper rectangle segment and said lower rectangle segment of said second conductor;

said first feed-in signal is transmitted to a connection area between said connection rectangle segment and an upper rectangle segment of said first conductor so as to generate a first radiated signal from said connection area between said connection rectangle segment and an upper rectangle segment of said first conductor, wherein said first radiated signal is transmitted from said connection area between said connection rectangle segment and an upper rectangle segment of said first conductor to a connection area between said connection rectangle segment and said lower rectangle segment of said second conductor to generate a first electrical path; and said first feed-in signal is transmitted to a connection area between said connection rectangle segment and said lower rectangle segment of said third conductor so as to generate a second radiated signal from said connection area between said connection rectangle segment and said lower rectangle segment of said third conductor, wherein said second radiated signal is transmitted from said connection area between said connection rectangle segment and said lower rectangle segment of said third conductor to said connection area between said connection rectangle segment and said lower rectangle segment of said second conductor to generate a second electrical path;

wherein said first electrical path and said second electrical path have different lengths.

2. The multi-frequency antenna according to claim 1, wherein a first outer conductor of said first feed cable is connected with said grounding member.

3. The multi-frequency antenna according to claim 1, wherein a second outer conductor of said first feed cable is connected with said grounding member.

4. The multi-frequency antenna according to claim 1, wherein positions where said first conductor, said second conductor and said third conductor are disposed overlap.

5. The multi-frequency antenna according to claim 1, wherein said lower rectangle segment of said first conductor is longer than said upper rectangle segment of said first conductor and said upper rectangle segment of said second conductor is longer than said lower rectangle segment of said second conductor.

6. The multi-frequency antenna according to claim 1, wherein gaps exist among said first plane, said second plane and said third plane.

7. The multi-frequency antenna according to claim 6, wherein said gaps accommodate air, glass, an acrylic board, or a printed circuit board.

8. The multi-frequency antenna according to claim 1, wherein said first electrical path and said second electrical path have a phase difference of 180 degrees.

9. The multi-frequency antenna according to claim 1, wherein said second conductor has an inverted-7 shape.

10. The multi-frequency antenna according to claim 1, wherein said third conductor has an inverted-7 shape.

* * * * *